United States Patent [19]

Wells

[11] Patent Number: 4,513,472

[45] Date of Patent: Apr. 30, 1985

[54] HEIGHT ADJUSTMENT MECHANISM

[76] Inventor: R. Leon Wells, 1649 Manor Dr., Vista, Calif. 92083

[21] Appl. No.: 548,995

[22] Filed: Nov. 7, 1983

[51] Int. Cl.[3] ..... A47L 5/34

[52] U.S. Cl. ..... 15/354

[58] Field of Search ..... 15/354–358

[56] References Cited

U.S. PATENT DOCUMENTS

| | | | |
|---|---|---|---|
| 1,643,763 | 9/1927 | Curry | 15/354 |
| 1,852,100 | 4/1932 | Ballou | 15/354 |
| 2,048,518 | 7/1936 | Ray | 15/354 X |
| 3,608,333 | 9/1971 | Selley et al. | 15/354 X |

*Primary Examiner*—Chris K. Moore

*Attorney, Agent, or Firm*—John J. Murphey

[57] ABSTRACT

A foot-operated height-adjustment mechanism for retrofit and replacement of the nozzle height-adjustment screw in an upright floor vacuum cleaner of the type characterized by having a front floor cleaning nozzle that is pivotally adjustable in height about the front wheels through raising and lowering the upwardly spring biased rear wheel carrier fork in contact with the screw comprising a threaded hollow tube, for receipt in the empty screw hole, a shaft slideably received in the tube, biased down against the carrier fork, an exposed mounting cap encircling the tube and including an aperture formed in one side thereof tapering inward to expose the shaft, a first lever extending out of the aperture, encircling the shaft and adapted to release the shaft when the other end is pressed down but preventing the shaft from upward movement within the tube when raised, the shaft biased in the upward, locked position, and a second lever adjacent the carrier fork and extending behind the rear wheels and terminating in an upwardly turned lip for depressing by the operator's foot to adjust the height of the floor cleaning nozzle above the floor.

17 Claims, 7 Drawing Figures

HEIGHT ADJUSTMENT MECHANISM

This invention pertains to an apparatus for cleaning carpets, rugs, floors, etc., by suction, commonly known as a vacuum cleaner. More particularly, this invention pertains to that type of vacuum cleaner that is pushed and pulled over the floor using an upstanding handle, known as an "upright" vacuum cleaner.

One of the most common models of upright vacuum cleaners has a wide floor-cleaning nozzle containing a rotating beater bar positioned in front of a set of widely spaced front wheels with the suction fan, motor and handle attachment located to the rear. The back of this unit is supported on a pair of narrowly spaced rear wheels that are mounted on a carrier fork, the fork extending rearward from a transverse horizontal pivot shaft located in the lower rear portion of the vacuum cleaner body and biased in an upward direction by a spring about the shaft.

To obtain the best vacuum for a particular depth of piled carpet, a screw is provided through a hole in the rear end of the rear housing to engage a cross-brace on the rear wheel carrier fork. By manually turning the screw inward, the rear end of the unit is lowered causing the front floor cleaning nozzle to pivot about the front wheels in a downward direction. Turning the screw in the opposite direction allows the pivot shaft spring to raise the rear wheels and cause the floor cleaning nozzle to rise. A visual suction indicator, on some brands called an "Adjust-O-Rite" (trademark), is provided in the front wall of the floor cleaning nozzle. When the manual turning of the screw produces the best vacuum position of the front cleaning nozzle, the button on the vacuum indicator "pops" in. As the vacuum cleaner is moved from one pile carpet to another, the screw must be turned to obtain the best vacuum.

Unfortunately, this height-adjustment screw is located within a few inches of the floor level. This means that the operator must kneel down each time an adjustment is made. In addition, the operator's face is now near the floor and with the machine running, dust swirls up into the nostrils causing sneezing and coughing. Elderly persons especially detest the constant stooping and kneeling required to turn the adjustment screw.

These type vacuum cleaners also exhibit the annoying tendency for the rear wheel carrier fork to "double-under" and jam against the underside of the vacuum cleaner housing beyond the maximum height-adjustment position; especially when the unit is being pulled backward and the rear wheels strike a raised floor portion such as the edge of a carpet. Although the pivot shaft spring strongly biases the carrier fork upward, it often weakens with age or breaks and allows this "doubling-under" to persist.

This invention is an infinitely variable height-adjustment mechanism that can be used on these upright vacuum cleaners and operated solely by the foot. Stooping and kneeling are eliminated; dust and dirt are kept away from the operator's hands and face; and all without any decrease in performance of the unit. In addition, this mechanism includes a stop device that eliminates the annoying "doubling-under" problem even when the pivot shaft spring is weak or broken. Even more novel is the fact that this inventive mechanism may be retrofitted onto existing models without any machining, tooling or other metal working. The manual height-adjustment screw is merely removed and discarded and the new mechanism is inserted in the same hole. The transverse pivot shaft is loosened and partially extracted so that one piece of the mechanism can be fitted thereover and the shaft retightened. A spring is then placed under the rear housing to engage the mechanism and the retrofit is completed.

Accordingly, the main object of this invention is an infinitely variable height-adjustment mechanism for replacement of the manual height-adjustment screw on upright vacuum cleaners of the type previously characterised. Further objects include a device that may be actuated solely by the operator's foot thus eliminating stooping and kneeling, a device that eliminates the "doubling-under" of the rear wheel carrier fork and a device that may be retrofitted on existing units without machining or other metal working. These and other objects will become more apparent to the reader upon studying the following detailed description of the preferred embodiment along with the drawings attached hereto; the protection sought by the inventor for this advance in the state-of-the-art is set forth in the claims that complete this disclosure.

DETAILED DESCRIPTION OF THE PREFERRED EMBODIMENT

Figure 1:
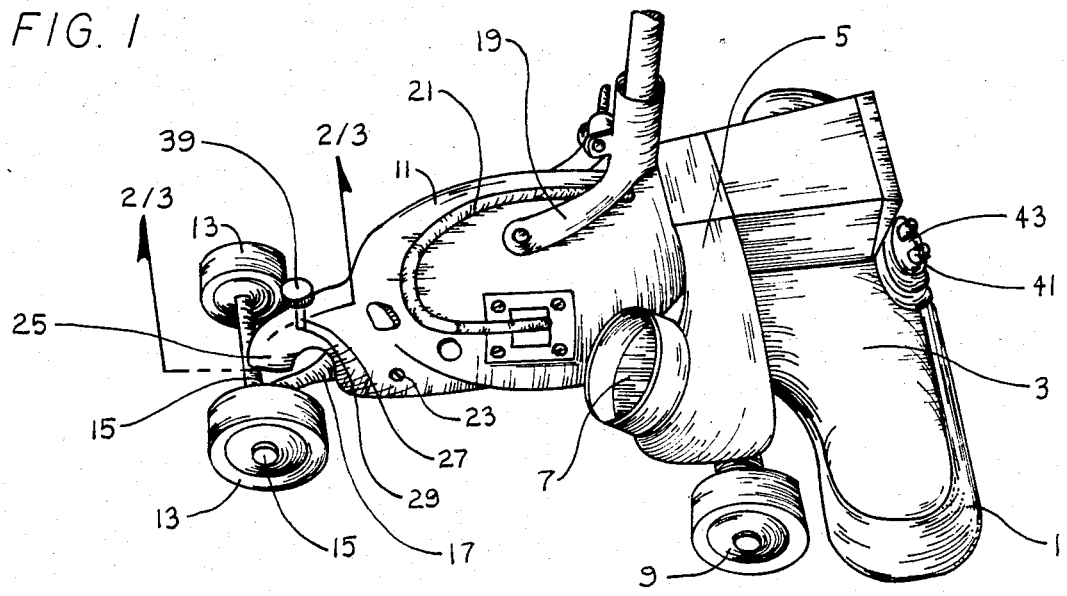
FIG. 1 is a perspective view of the typical upright vacuum cleaner to which this invention pertains.

The upright vacuum cleaner to which this invention pertains is shown in FIG. 1 and is characterized by a wide front floor cleaning nozzle 1 directed downward for suction cleaning of carpets and floors that passes the dirt-ladened air upward into a central duct 3 then into the center of a centrifugal fan (not shown). The dirt-ladened air is swirled at high velocity inside a centrifugal fan housing 5 where it is caused to exit at a high pressure and velocity through a side mounted fan exit duct 7 into a dirt-catching bag (not shown). Nozzle 1 is pivotally supported on a pair of widely spaced front wheels 9. The electric motor (not shown) that powers the centrifugal fan is housed in a motor housing 11 that extends rearward from wheels 9. Rear support is provided by a pair of narrowly spaced rear wheels 13 rotating about a common axle 15 that is carried on a rear wheel carrier fork 17. A push-pull handle (not shown) is attached to motor housing 11 by connector 19; electrical power is supplied to the unit through cord 21.

Fork 17 is pivotally connected at its front end to motor housing 11 via a transverse horizontal pivot shaft 23 located in the lower rear portion thereof. A projection 25 extends rearward of motor housing 11 over top of rear wheel carrier fork 17 and serves to support a cleaning nozzle height-adjustment screw 27 that is threaded through a hole 29 into engagement with a cross-brace 31 on carrier fork 17 (see FIG. 2). A strong coil spring 33 is wrapped about pivot shaft 23 with its ends 35 and 37 against motor housing 11 and the underside of cross-brace 31 respectively to bias carrier fork 17 in an upward direction or clockwise as viewed in FIG. 2.

Figure 2:
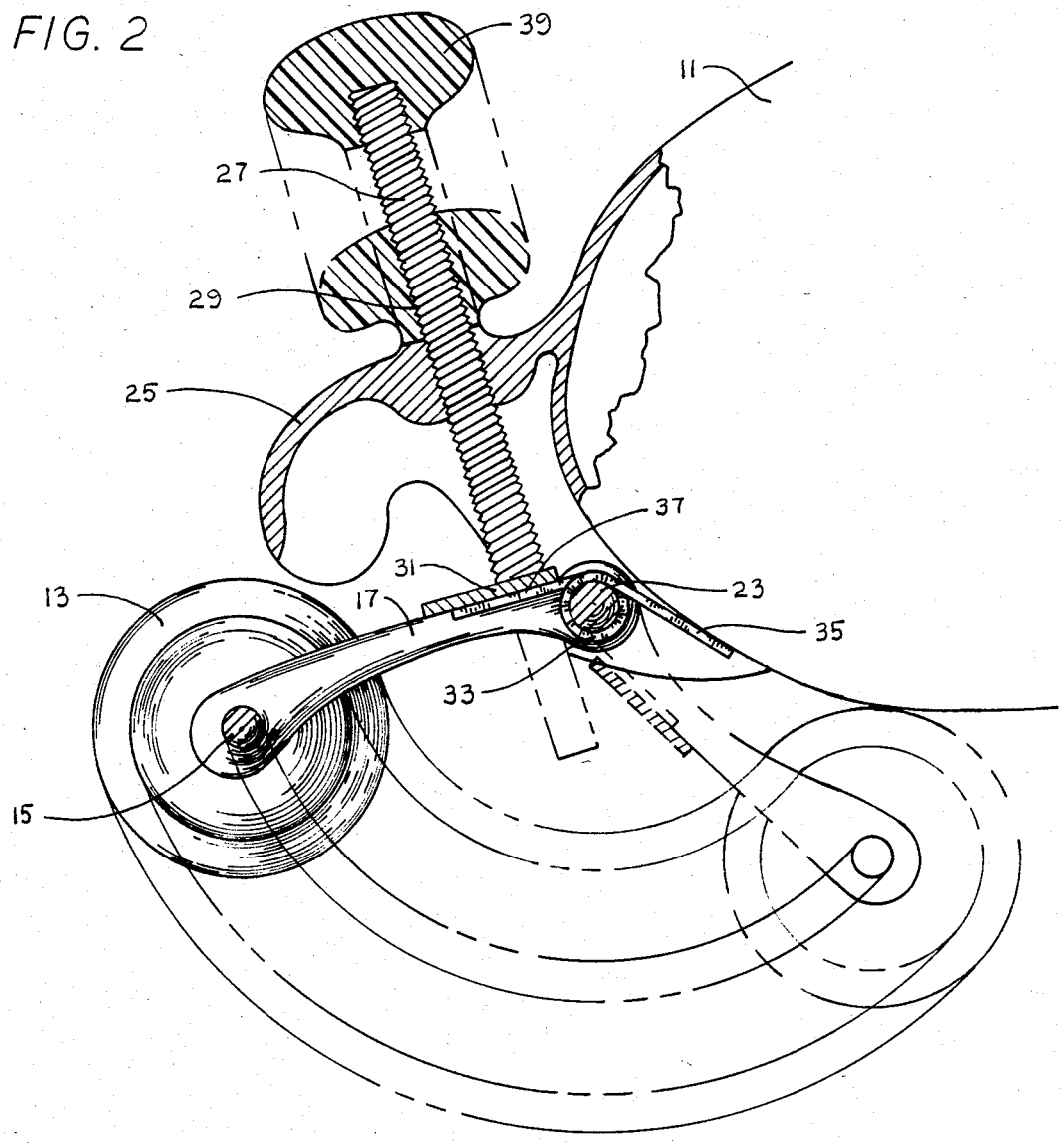
FIG. 2 is a side elevational view in partial cross-section of the rear end of the typical unit showing the existing configuration of the manual height-adjustment screw taken along lines $\frac{2}{3}$—$\frac{2}{3}$ in FIG. 1.

As the turning knob 39 on top of screw 27 is twisted clockwise, carrier fork 17 is rotated counterclockwise against the bias pressure of spring 33 and wheels 13 are lowered thus pivoting cleaning nozzle 1 about front wheels 9 toward the floor. Turning knob 39 in the other direction reverses the process, allowing spring 33 to raise carrier fork 17 and wheels 13, causing nozzle 1 to rise. When the proper vacuum is achieved, button 41 on the Adjust-O-Rite (trademark) unit 43 "pops" in. As shown in FIG. 2, by phantom lines, when knob 39 is turned clockwise too far and spring 33 is weak or broken or upon the rearward pull of the vacuum cleaner causing rear wheels 13 to strike a projection, rear wheel carrier fork 17 often doubles-under jamming rear wheels 13 against the under belly of motor housing 11, an undesirable condition indeed.

Figure 3:
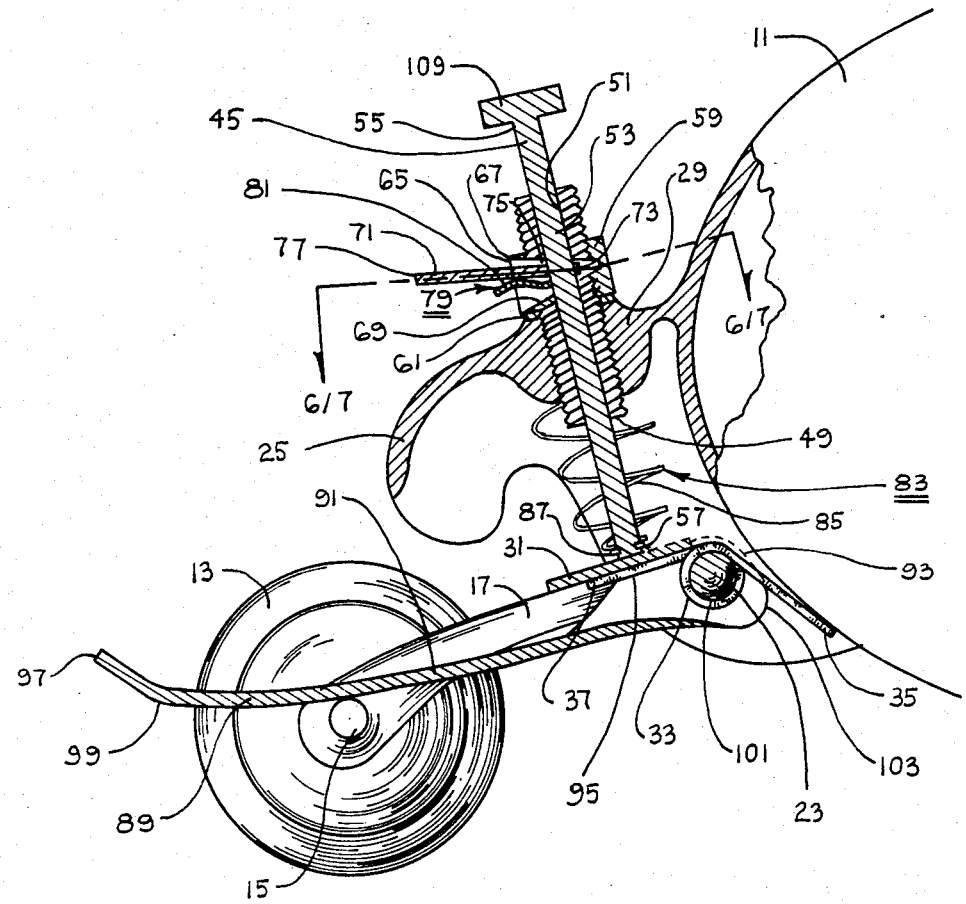
FIG. 3 is the same view as is FIG. 2 showing the retrofitted mechanism of this invention in full cross-section taken along the same lines $\frac{2}{3}$—$\frac{2}{3}$ as in FIG. 1.

As shown in FIG. 3, this novel invention begins with an elongated hollow tube 45 of finite length having a top end 47, exterior of rear motor housing projection 25, a bottom end 49, interior or under projection 25 and a smooth hollow passageway 51 interior thereof running from end to end. Tube 45 may be constructed of a wide variety of hard materials such as steel, iron, aluminum and certain plastics and even wood. It is threaded on the outside or otherwise adapted for fixed receipt into hole 29 from whence screw 27 has been removed. Its purpose is to provide a carrier for a shaft 53 that is slideably received in passageway 51 and that has top and bottom ends 55 and 57 respectively, said bottom end 57 extending beyond bottom tube end 49 for height-adjustment contact with cross-brace 31.

Figure 6:
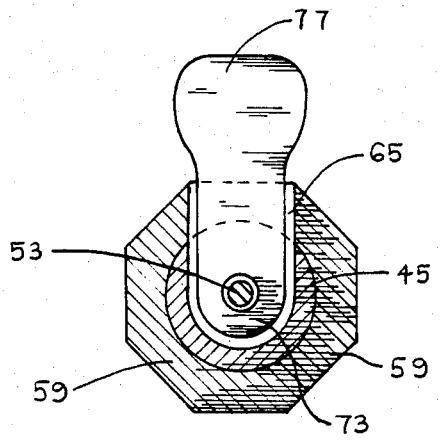
FIG. 6 and FIG. 7 are cross-sectional views of different embodiments of the first (of two) levers of this invention taken along lines 6/7—6/7 in FIG. 3.
Figure 7:
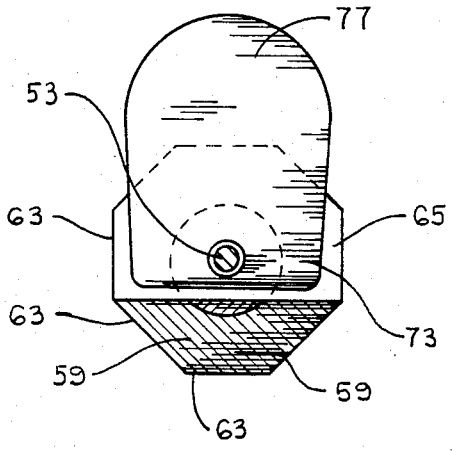

A mounting cap 59 is threaded or otherwise adapted for receipt onto tube 45 above housing projection 25 and serves to hold said tube along with a lock washer 61 into locked position in hole 29. Cap 59 may be of a wide variety of configurations but for simplicity and ease of mounting may merely encircle tube 45 and include a series of equal sized and equal spaced outer faces 63 to allow tightening with a common wrench. An aperture 65 is formed in one side of cap 59, forming top and bottom aperture surfaces 67 and 69 respectively, extending inwardly toward the center, tapering as it progresses, to expose shaft 53. Aperture 65 is shown in FIGS. 6 and 7 to be capable of a wide variety of configurations and yet still be within the scope of the invention. FIG. 6 shows a relatively narrow aperture while FIG. 7 shows a wide aperture, both coming within the scope of this invention.

A first lever 71 is provided with one end 73 inserted in aperture 65 having an aperture or hole 75 formed therein through which shaft 53 passes. The other lever end 77 extends outward and rearward of the vacuum cleaner body. Hole 75 is slightly larger than shaft 53; lever 71 is arranged to loosen on shaft 53 when lever end 77 is depressed to its lowest point and fixedly clasp shaft 53 to prevent upward sliding motion when raised. This brake action may be accomplished even if lever 71 does not fully encircle shaft 53 by adapting lever end 73 to partially contact and bear against shaft 53 in an offset hinge arrangement when lever end 77 is raised, as is known in the art.

Means 79 is provided in aperture 65 for biasing lever 71 in an upwardly angled direction relative to rear wheels 13 so as to clasp shaft 53 and restrain it from rising within passageway 51. Means 79 is shown in FIG. 3 to comprise a leaf spring 81 interposed lever 71 and the bottom aperture surface 69. Other biasing means 79 may be used in lieu thereof such as a coil spring interposed lever 71 and the outer edge of aperture surface 69 or a washer-spring interposed lever 71 and aperture surface 69, etc.

Means 83 is provided to bias shaft 53 in a downward direction to contact rear wheel carrier fork cross-brace 31. The downward biasing pressure must be less than the upward biasing pressure of spring 33. Means 83 is shown in FIG. 3 to comprise a coil spring 85 interposed bottom tube end 49 and connected to bottom shaft end 57 by a clip 87 or other connection means to provide expansion bias and force bottom shaft end 57 against cross-brace 31.

A second lever 89 comprising a wide center portion 91 disposed adjacent rear wheel carrier fork 17, over axle 15, and having a forward end 93 bent into the vertical plane and that contains a raised portion 95 for abutment against the underside of cross-brace 31 is provided in restrained engagement with carrier fork 17. Lever 89 terminates at the rear end 97 thereof which is formed into an upwardly turned lip 99.

This mechanism operates in the following fashion: The operator first depresses lever end 77 with the foot while pushing vertically downward on the upright vacuum cleaner handle. This action forces shaft 53 to move upward and raises rear wheel carrier fork 17 and front nozzle 1 to their highest permissible positions. Next, the operator turns the vacuum cleaner on and slowly steps down on lip 99 while watching the Adjust-O-Rite (trademark) button. As lip 99 is depressed, front cleaning nozzle 1 is slowly lowered to the floor. Simultaneously, shaft 53 is lowered by the pressure of bias means 83 that keeps shaft end 87 in contact with cross-brace 31. When the proper vacuum is achieved, button 41 "pops" in and the vacuum cleaner is ready for use. Shaft 53, locked against upward travel by lever 71, and the bias pressure of spring 33 will hold carrier fork 17 and rear wheels 13 at the present position during use of the vacuum cleaner.

Figure 4:
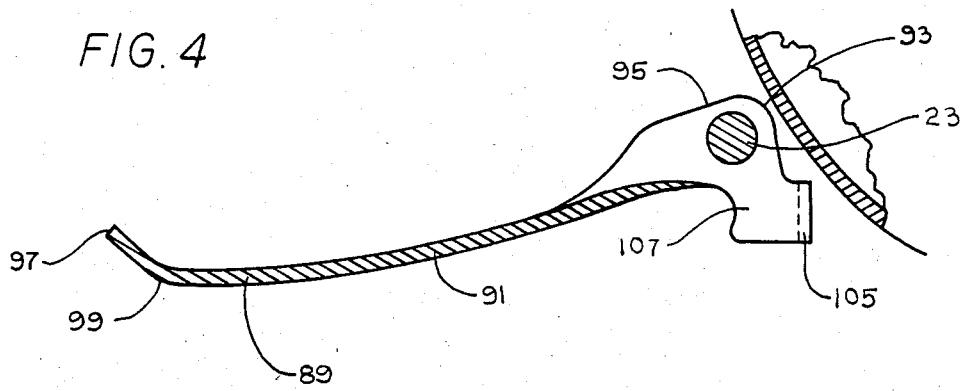
FIG. 4 is a side elevational view of another embodiment of one of the parts of this inventive mechanism shown in position relative to the vacuum cleaner body as in FIG. 3.

To prevent unwanted "doubling-under" of rear wheel carrier fork 17, lever 89 is provided with an aperture 101 for receipt therethrough of transverse horizontal pivot shaft 23 and is adapted to prevent the "doubling-under" by having formed on forward end 93 a short protrusion 103 below and forward of shaft aperture 101 for contact with motor housing 11 when carrier fork 17 is lowered or pivots about shaft 23 in a counterclockwise direction to its lowest desired point. While this provides the required protection as aforesaid, protrusion 103 may flatten through extended use and ultimately allow the "doubling-under" to resume. To prevent this, a modification is shown in FIG. 4 comprising a tab 105 depending from a leg 107 that is provided in lieu of protrusion 103. Tab 105 is bent sideways from the vertical plane into a plane parallel with shaft 23. Contact between tab 105 and motor housing 11 will now provide the same "doubling-under" protection with less chance of wearing flat through extended use.

If desired, a wide cap 109 may be fixed to top shaft end 55 to prevent shaft 53 from dropping all the way through passageway 55; however, such is not imperative to the normal function of the device of this invention.

Figure 5:
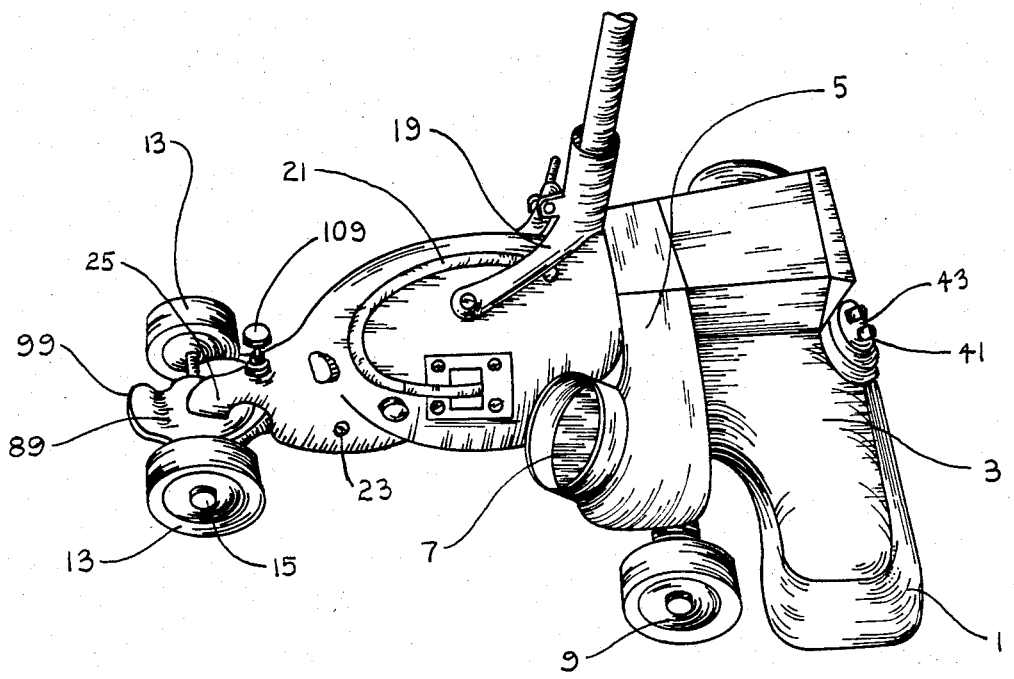
FIG. 5 is a perspective view of the upright vacuum cleaner showing the mechanism of this invention installed in its operative mode.

FIG. 5 shows the same type of vacuum cleaner as in FIG. 1 except the device of this invention has been provided and retrofitted in lieu of height-adjustment screw 27. The overall appearance and operation of the vacuum cleaner remains unchanged except that the height-adjustment device of this inveniton provides easier vacuum adjustment and more enhanced utilization.

I claim:

1. A foot-activated nozzle height-adjustment mechanism to replace the nozzle height-adjustment screw in an upright floor vacuum cleaner of the type characterized by having a front floor cleaning nozzle that is pivotally adjustable in height about the front wheels through raising and lowering an upwardly biased rear wheel carrier fork in contact with the screw, comprising:

(a) an elongated hollow tube of finite length, having top and bottom ends respectively, adapted for receipt in the same hole as the replaced adjustment screw;

(b) a shaft slideably received in said tube having top and bottom ends respectively wherein said bottom end extends beyond said bottom tube end for height-adjustment contact with the rear wheel carrier fork;

(c) an exposed mounting cap encircling said tube and including a wide aperture formed in one side thereof tapering inwardly to expose said shaft and comprising top and bottom aperture surfaces;

(d) a first lever having one end in said aperture contacting said shaft and extending outward and rearward of the vacuum cleaner adapted to release said shaft when depressed and when raised to prevent upward motion of said shaft in said tube;

(e) means for biasing said lever in an upward direction;

(f) means for biasing said shaft downward toward the rear wheel carrier fork; and, (g) a second lever disposed adjacent the rear wheel carrier fork and extending rearward thereof and terminating in an upwardly turned lip for depressing the rear wheels, such as with the operator's foot, to raise the rear end of the vacuum cleaner and pivotally lower the front cleaning nozzle.

2. The mechanism of claim 1 wherein said second lever extends forward and has formed therein an aperture for receipt therethrough of the rear wheel carrier fork pivot shaft and is adapted to prevent the rear wheel carrier fork from pivoting under the vacuum cleaner.

3. The mechanism of claim 2 wherein said forward terminal end of said second lever includes a short protrusion below and forward of said shaft aperture for contact with the vacuum cleaner body to limit the pivotal travel of said lever and carrier fork.

4. The mechanism of claim 2 wherein said forward terminal end of said second lever includes a tab depending therefrom arranged to contact the vacuum claaner body and prevent further lowering of the vacuum cleaner rear wheels beyond a desired point.

5. The mechanism of claim 1 wherein said means for biasing said first lever in an upward direction comprises a leaf spring interposed said first lever and said bottom aperture surface in said mounting cap.

6. The mechanism of claim 1 wherein said means for biasing said shaft downward toward the rear wheel carrier fork comprises a coil spring adapted to provide expansion biasing between said hollow tube and said bottom end of said shaft and is of less bias pressure than the upward bias pressure on the rear wheel carrier fork.

7. The mechanism of claim 1 including a cap fixed to said top shaft end adapted to prevent passage of said top shaft end into said tube.

8. The mechanism of claim 1 including a lock washer under said mounting cap.

9. In an upright vacuum cleaner, characterized by having a front floor-cleaning nozzle that is adjustable in height by manual turning of a screw threaded through the vacuum cleaner rear housing to contact and pivot an upwardly biased rear wheel carrier fork and wheels about a shaft, the improvement of replacing the height-adjustment screw with a foot-activated height-adjustment mechanism comprising:

(a) an elongated hollow tube of finite length, having top and bottom ends respectively, adapted for receipt in the same hole as the replaced adjustment screw;

(b) a shaft slideably received in said tube having top and bottom ends respectively wherein said bottom end extends beyond said bottom tube end for height-adjustment contact with the rear wheel carrier fork;

(c) an exposed mounting cap encircling said tube and including a wide aperture formed in one side thereof tapering inwardly to expose said shaft and comprising top and bottom aperture surfaces;

(d) a first lever having one end in said aperture contacting said shaft and extending outward and rearward of the vacuum cleaner adpated to release said shaft when depressed and fixedly clasping said shaft against upward movement when raised;

(e) means for biasing said lever in an upward direction;

(f) means for biasing said shaft downward toward the rear wheel carrier fork; and, (g) a second lever disposed adjacent the rear wheel carrier fork and extending rearward beyond the vacuum cleaner rear support wheels terminating at an upwardly turned lip for depressing the rear wheels, such as with the operator's foot, to raise the rear end of the vacuum cleaner and pivotally lower the front cleaning nozzle.

10. The height-adjustment mechanism of claim 9 wherein said second lever extends forward and has formed therein an aperture for receipt therethrough of the rear wheel carrier fork pivot shaft and is adapted to prevent the rear wheel carrier fork from pivoting under the vacuum cleaner.

11. The height-adjustment mechanism of claim 10 wherein said forward terminal end of said second lever includes a short protrusion below and forward of said shaft aperture for contact with the vacuum cleaner body to limit the pivotal travel of said lever.

12. The height-adjustment mechanism of claim 10 wherein said forward terminal end of said second lever includes a tab depending therefrom arranged to contact the vacuum cleaner body and prevent further lowering of the vacuum cleaner rear wheels beyond a desired point.

13. The height-adjustment mechanism of claim 10 wherein said means for biasing said first lever in an upward direction comprises a leaf spring interposed said first lever and said bottom aperture surface in said mounting cap.

14. The height-adjustment mechanism of claim 10 wherein said means for biasing said shaft downward toward the rear wheel carrier fork comprises a coil spring adapted to provide expansion biasing between said hollow tube and said bottom end of said shaft of less bias pressure than the upward bias pressure on the rear wheel carrier fork.

15. The height-adjustment mechanism of claim 10 including a cap fixed to said top shaft end adapted to prevent passage of said top shaft end into said tube.

16. A foot-activated nozzle height-adjustment mechanism to replace the nozzle height-adjustment screw in an upright floor vacuum cleaner of the type characterized by having a front floor cleaning nozzle that is pivotally adjustable in height about the front wheels through raising and lowering an upwardly biased rear wheel carrier fork in contact with the screw, comprising:

(a) an elongated hollow tube of finite length, having top and bottom ends respectively, for threaded receipt in the same hole as the replaced adjustment screw;

(b) a shaft slideably received in said tube having top and bottom ends respectively wherein said bottom end extends beyond said bottom tube end for height-adjustment contact with the rear wheel carrier fork and said top end extends beyond said top tube end and includes a wide cap to prevent said shaft from dropping out of said tube;

(c) an exposed mounting cap encircling said tube and including a wide aperture formed in one side thereof tapering inwardly to expose said shaft and comprising top and bottom aperture surfaces;

(d) a first lever having one end in said aperture between said surfaces and having a hole formed therein, slightly larger than said shaft, for receipt therethrough by said shaft, and extending outward and rearward of the vacuum cleaner and arranged to loosen on said shaft when depressed and fixedly clasping said shaft to prevent upward movement within said tube when raised;

(e) leaf spring means in said aperture to bias said lever in an upward, shaft-locked position;

(f) coil spring means attached to said bottom end of said shaft to bias said shaft downward and against the rear wheel carrier fork of less bias pressure than the upward bias pressure on said carrier fork; and, (g) a second lever centrally disposed between the rear wheels in fixed relationship against the rear wheel carrier and extending rearward beyond the vacuum cleaner rear support wheels terminating at an upwardly turned lip for depressing the rear wheels, such as by the operator's foot, to raise the rear end of the vacuum cleaner and pivotally lower the front cleaning nozzle, and wherein said lever extends forward and has formed therein an aperture for receipt therethrough of the rear wheel carrier fork attachment shaft and further includes a tab depending therefrom arranged to contact the vacuum cleaner body and prevent further lowering of the vacuum cleaner rear wheels beyond a desired point.

17. The mechanism of claim 18 including a lock washer under said mounting cap.

* * * * *